US005533892A

United States Patent [19]

Long

[11] Patent Number: 5,533,892

[45] Date of Patent: Jul. 9, 1996

[54] LIQUID FUEL LANTERN WITH ELECTRONIC IGNITION

[75] Inventor: Norris R. Long, Wichita, Kans.

[73] Assignee: The Coleman Company, Inc., Wichita, Kans.

[21] Appl. No.: 281,743

[22] Filed: Jul. 28, 1994

Related U.S. Application Data

[63] Continuation-in-part of Ser. No. 74,133, Jun. 9, 1993, Pat. No. 5,336,084.

[51] Int. Cl.[6] ..... F23Q 3/00

[52] U.S. Cl. ..... 431/264; 431/107; 431/255; 431/344

[58] Field of Search ..... 431/264, 100, 431/344, 107, 104, 354, 156, 255

[56] References Cited

U.S. PATENT DOCUMENTS

| | | | |
|---|---|---|---|
| Re. 29,457 | 10/1977 | Hastings | 431/123 |
| 1,201,030 | 10/1916 | Ewing . | |
| 1,202,079 | 10/1916 | Lyon . | |
| 1,340,843 | 5/1920 | Smith . | |
| 1,366,591 | 1/1921 | Passano . | |
| 2,431,665 | 11/1947 | Tullis | 431/107 |
| 2,515,518 | 7/1950 | Knoy et al. | 431/107 |
| 3,773,458 | 11/1973 | Spotts | 431/156 X |
| 3,843,311 | 10/1974 | Nelson | 431/109 |
| 4,131,414 | 12/1978 | Curtis | 431/104 |
| 4,662,353 | 5/1987 | Mifune | 431/255 |
| 4,691,136 | 9/1987 | Schmidt | 431/255 X |
| 4,830,606 | 5/1989 | Dillinger | 431/255 |
| 4,870,314 | 9/1989 | Hefling | 431/255 X |
| 5,336,084 | 8/1994 | Long | 431/354 |

*Primary Examiner*—Larry Jones

[57] ABSTRACT

A liquid fuel lantern having a catalytic mantle includes a pilot tube for conveying fuel to a point adjacent the mantle. An ignition device is mounted near the pilot tube for igniting the fuel which flows from the pilot tube.

6 Claims, 3 Drawing Sheets

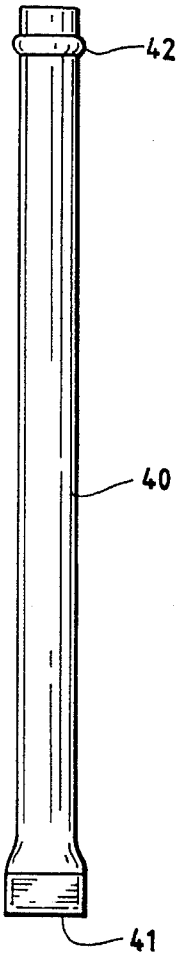
FIG. 7
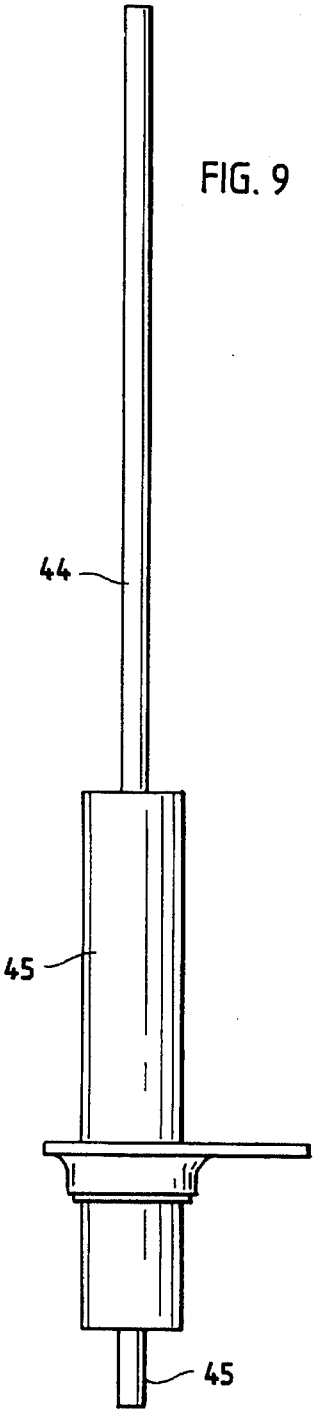
FIG. 9
FIG. 8
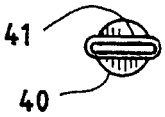
FIG. 10
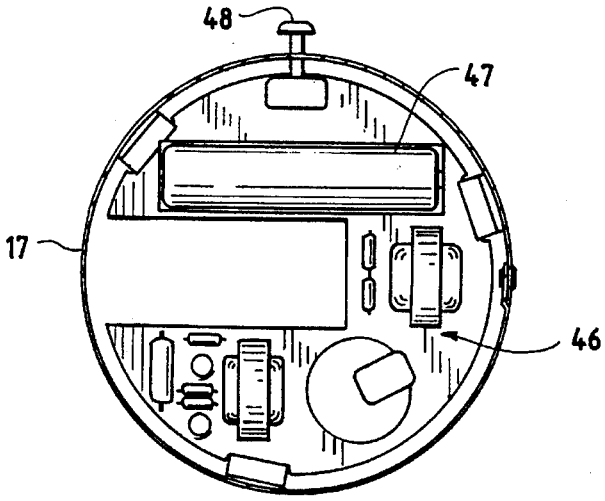

LIQUID FUEL LANTERN WITH ELECTRONIC IGNITION

RELATED APPLICATION

This application is a continuation-in-part of my copending application entitled "LIQUID FUEL CAMPSTOVE WITH ELECTRONIC IGNITION", Ser. No 08/074,133, filed Jun. 9, 1993, now U.S. Pat. No. 5,336,084, issued Aug. 9, 1994.

BACKGROUND

This invention relates to liquid fuel burning appliances, and, more particularly, to a liquid fuel lantern which is equipped with an electronic ignition system.

Liquid fuel lanterns for camping and outdoor use are well known and are described, for example, in U.S. Pat. No. Re. 29,457, which is owned by The Coleman Company, Inc. Liquid fuel which is used in such lanterns can be Coleman fuel, white gas, unleaded gasoline, etc.

In conventional liquid fueled lanterns such as the ones which Coleman has offered for many years, fuel is contained in a pressure vessel or fuel tank into which air is pumped under pressure. As described in U.S. Pat. No. Re. 29,457, the fuel tank is equipped with a dip tube which extends to nearly the bottom of the tank. The dip tube is closed at the bottom with the exception of a small diameter orifice through which fuel is allowed to enter. The dip tube has an internal conduit which is open at the bottom and which communicates with the upper part of the fuel tank above the maximum intended fuel level. The dip tube orifice can be partly blocked by insertion of a needle which is suitably connected to the fuel control system so as to cause it to partly block the orifice during the lighting cycle and to leave the orifice unblocked during the normal burn cycle. The upper end of the dip tube is connected through a valve system to a generator. The generator is a metal tube which passes into a venturi tube which is connected to one or more catalytic mantles. Fuel is discharged at high velocity from an orifice at the end of the generator into the venturi where air is aspirated and mixed and fed to the catalytic mantle as a combustible mixture for burning.

Before the lantern is lit, the generator is cool, and fuel which flows through the generator is not vaporized. The unvaporized fuel which is discharged through the generator orifice is not readily ignitable at the mantle. To overcome this problem, a dip tube needle can be used to partly block the fuel entry orifice. This creates a pressure imbalance within the dip tube which permits pressurized air to flow through the passageway inside of the dip tube from above the fuel. This pressurized air mixes with the liquid fuel and moves with it to be discharged from the generator orifice. The fuel/air mixture which is discharged from the generator orifice consists of a fuel-vapor-laden air and atomized droplets of fuel which can be ignited at the mantle by a lit match.

After the fuel/air mixture which flows into the mantle is ignited, the generator will eventually be heated sufficiently to vaporize the fuel which flows through the generator. The fuel control system can then be adjusted to move the needle in the fuel entry orifice of the dip tube so that only fuel flows through the dip tube to the generator.

U.S. Pat. Nos. 4,870,314, 4,691,16, and 3,843,311 describe propane or LP lanterns which are equipped with piezoelectric ignition devices. Rather than using a lighted match, the LP gas is ignited by a spark which is generated by the piezoelectric device.

Liquid fuel lanterns are more difficult to light than LP lanterns. LP gas is gaseous at atmospheric pressure and temperature and is easily ignited by a spark, even under cold conditions.

On the other hand, liquid fuel is a liquid at atmospheric pressure and temperature. It is therefore more difficult to provide automatic spark ignition of the fuel/air mixture of a liquid fuel appliance, especially under cold conditions. As the fuel/air mixture flows into the mantle, it mixes with more air which makes the fuel mixture leaner. The lean fuel mixture is more difficult to light with a sparking device, and the difficultly increases as the ambient temperature decreases.

SUMMARY OF THE INVENTION

This invention enables a liquid fuel lantern to be easily ignited by a sparking device. A pilot tube conveys fuel directly from the burner assembly to the ignition device, and the fuel which flows out of the pilot tube is richer than the fuel which flows out of the burner and reaches the ignition device. The spark ignites a flame at the end of the pilot tube, and the flame ignites the fuel which flows out of the burner.

DESCRIPTION OF THE DRAWING

The invention will be explained in conjunction with an illustrative embodiment shown in the accompanying drawing, in which

FIG. 7 is a front elevational view of the pilot tube;

FIG. 8 is a bottom plan view of the pilot tube;

FIG. 9 is an enlarged elevational view of the ignition electrode; and

FIG. 10 is a top plan view of the spark generator assembly as would be seen along the line 10—10 of FIG. 2.

DESCRIPTION OF SPECIFIC EMBODIMENT

Figure 1:
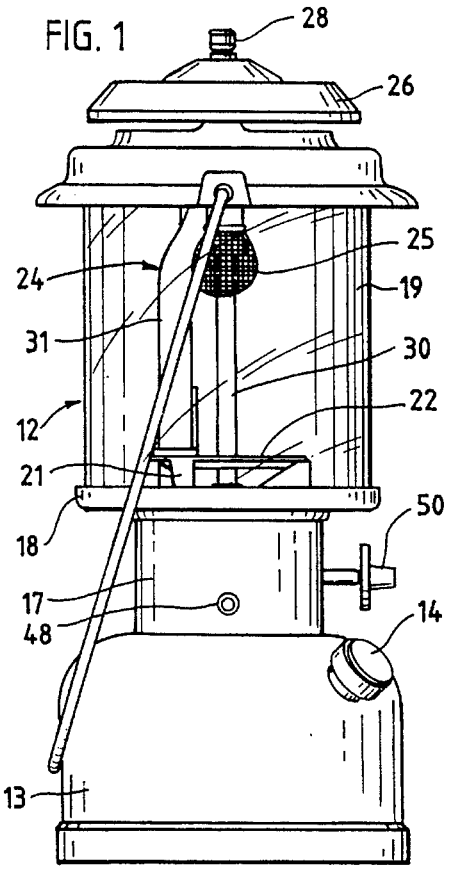
FIG. 1 is a side elevational view of a lantern which is equipped with an electronic ignition system in accordance with the invention.
Figure 3:
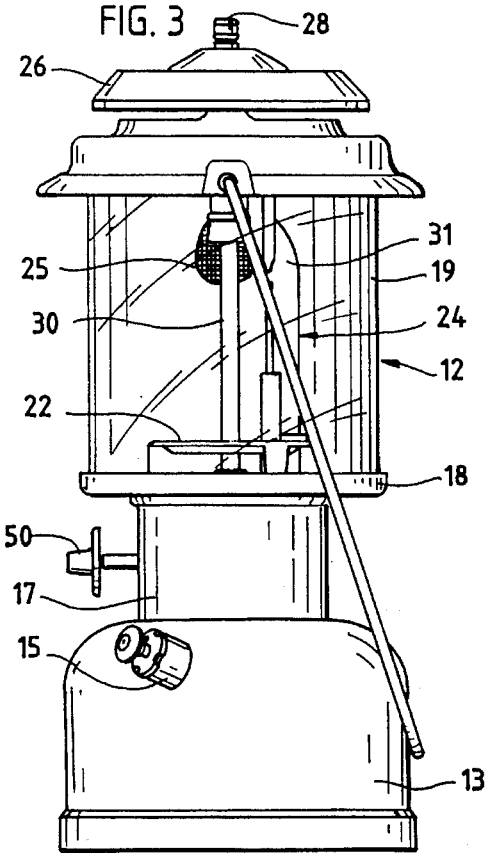
FIG. 3 is a front elevational view of the lantern, partially broken away.
Figure 2:
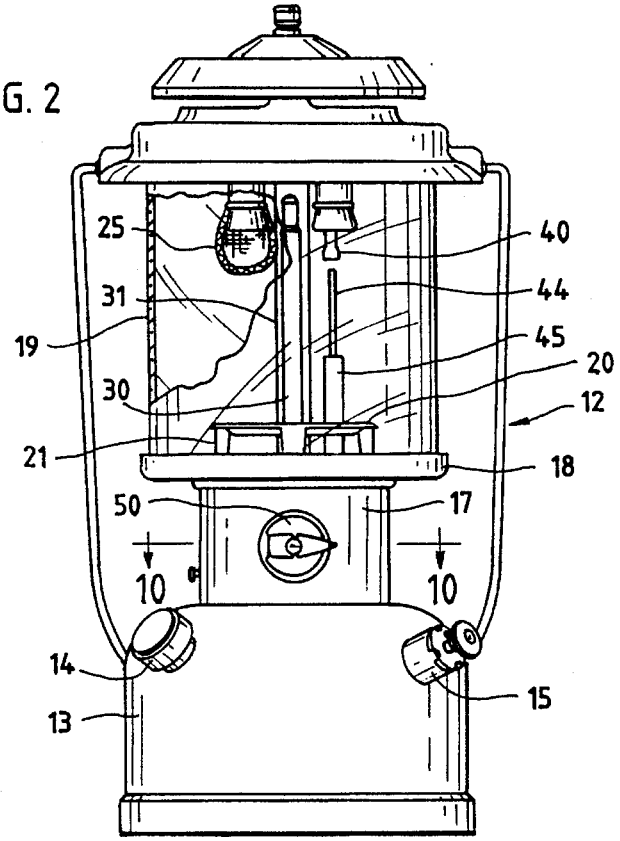
FIG. 2 is a side elevational view of the other side of the lantern of FIG. 1.

Referring to FIGS. 1–3, the numeral 12 designates generally a liquid fuel lantern. With the exception of the electronic ignition system which will be described hereinafter, the lantern is a conventional Coleman lantern. Such lanterns are described, for example, in U.S. Pat. No. Re. 29,457.

The lantern includes a fuel tank or fount 13 which also serves as the base for the lantern. The tank includes a fill spout 14 and an air pump 15.

A cylindrical collar 17 and a pan 18 are supported by the fuel tank. The pan supports a cylindrical globe 19. A heat shield 20 includes three legs 21 which are supported by the pan and a circular flat plate 22.

A metal burner assembly 24 extends upwardly within the globe and conducts fuel from the fuel tank 13 to a pair of catalytic mantles 25. Only one of the mantles is illustrated in FIGS. 1–3. A ventilator cover 26 is mounted on top of the globe and is secured to a threaded stud 27 (FIGS. 4 and 5) on the burner assembly by a screw knob 28.

Figure 4:
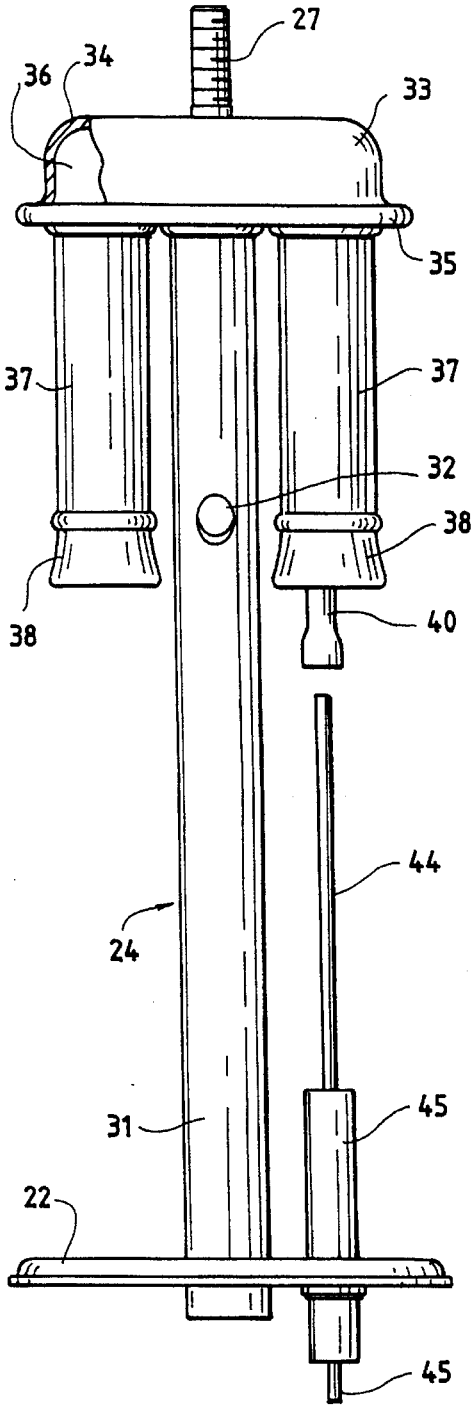
FIG. 4 is a front elevational view, partially broken away, of the burner assembly and ignition electrode.
Figure 5:
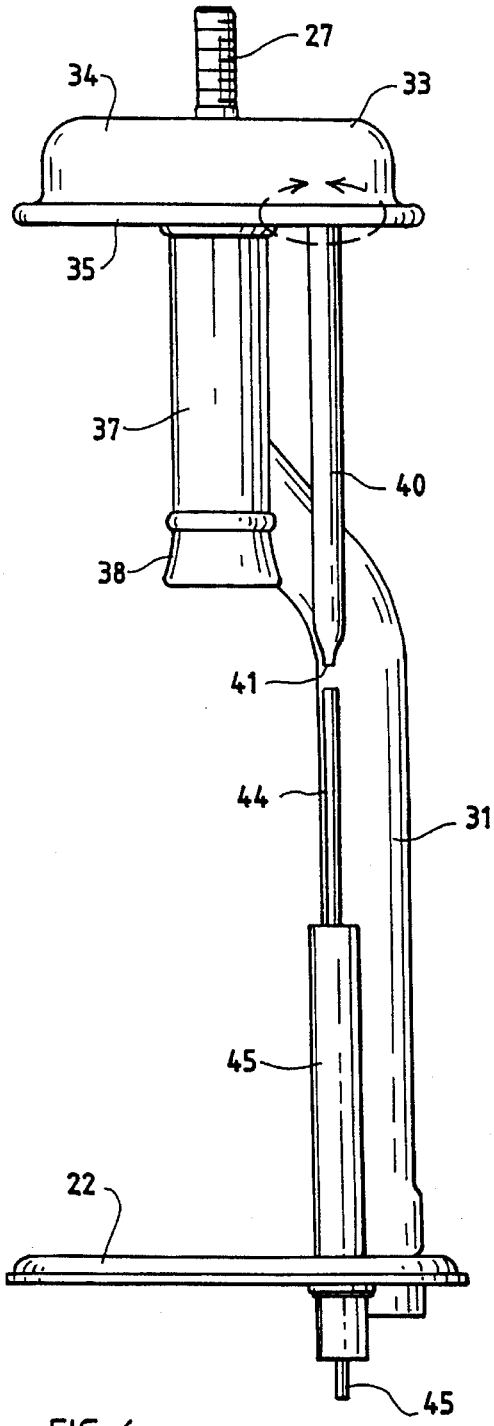
FIG. 5 is a side elevational view of the burner assembly and ignition electrode.

The metal burner assembly 24 includes a generator tube 30 which communicates with the fuel tank and an inlet tube 31 (see also FIGS. 4 and 5). The bottom of the inlet tube extends through the heat shield plate 22 and pan 18, and ambient air can flow into the open bottom end of the inlet tube through openings in the collar 17. The upper end of the generator tube 30 extends through an opening 32 (FIG. 4) in the inlet tube, and a conventional fuel orifice or jet nozzle is mounted on the upper end of the generator. The diameter of the inlet tube is reduced above the fuel jet to provide a venturi which aspirates air into the open bottom end of the inlet tube.

The inlet tube 31 is connected to a generally cylindrical burner top 33 (FIGS. 3 and 4). The burner top is formed from an inverted top cup 34 and a bottom plate 35 which is crimped around the cup to provide an internal chamber 36 (FIG. 4). A pair of outlet tubes 37 are connected to the burner top on either side of the inlet tube 31. Each outlet tube terminates in an outwardly flared bottom end 38 which is adapted to support one of the mantles 25.

Figure 6:
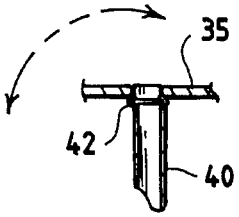
FIG. 6 is a fragmentary sectional view of the upper portion of the pilot tube.

A metal pilot tube 40 is connected to the bottom plate 35 of the burner top and extends to a position adjacent one of the mantles 25. The main portion of the pilot tube is cylindrical, and the bottom end is deformed or flattened to provide an elongated oval opening or slit 41 (FIG. 8). The upper end of the pilot tube includes a circumferential rib 42 (FIG. 7) which abuts the bottom plate 35 of the burner top, and the top of the tube is flared over the bottom plate 35 (FIG. 6) to secure the pilot tube.

An electrode 44 is spaced slightly from the bottom end of the pilot tube to form a spark gap of about 3/16 inch. The electrode is mounted in an insulator 45, and the insulator is supported by the heat shield plate 22. A wire 45 connects the electrode 44 to a spark generator assembly 46 (FIG. 10) which is housed within the collar 17.

Spark generating devices of the type illustrated in FIG. 10 are conventional and well known. The device is powered by a AAA battery 47 and is actuated by a pushbutton 48 which extends through the collar 17. When the pushbutton is depressed, a spark is generated at the spark gap between the electrode 44 and the metal pilot tube 40.

Another type of spark generator device which could be used is a manually operated piezoelectric device such as the devices described in U.S. Pat. Nos. 4,870,314 and 4,691,136.

Operation

Before the lantern is operated, the liquid fuel within the tank is pressurized with air by the air pump 15. Flow of fuel from the tank through the generator tube 30 is controlled by a valve and a valve knob 50 (FIGS. 1–3). When the valve is opened, the instant lighting system of the lantern causes a fuel/air mixture to flow from the fuel tank through the generator tube. The fuel/air mixture flows at high speed through the generator jet, and as the fuel/air mixture flows through the venturi of the inlet tube 31, additional air is aspirated into the mixture through the open bottom end of the inlet tube 31.

The fuel/air mixture flows into the chamber 36 of the burner top 33. The main portion of the fuel/air mixture flows out of the chamber through the two outlet tubes 37. A minor portion of the fuel/air mixture flows through the pilot tube 40.

When the spark generator is actuated by the pushbutton 48, a spark jumps from the electrode 44 to the pilot tube 40 and ignites the fuel/air mixture which flows from the pilot tube. The ignited gas in turn ignites the fuel/air mixture which is flowing from the outlet tubes 37 into the mantles 25. The lantern is thereafter operated in the conventional manner.

After the generator tube 30 is heated sufficiently to vaporize the fuel, the instant lighting system is adjusted so that only fuel flows through the generator tube. Primary combustion air will still be incorporated with the fuel when the fuel flows through the jet into the venturi of the inlet tube 31. A small portion of fuel will continue to flow through the pilot tube during operation of the lantern and will cause a small flame at the end of the pilot tube. However, the majority of the fuel will burn within the catalytic mantles.

Since the spark is generated directly at the exit of the pilot tube 40, the fuel/air mixture is relatively rich in fuel and can be ignited easily by the spark even in cold weather. On the other hand, if the electrode were positioned so that the fuel/air mixture flowing through one of the mantles were ignited, the fuel/air mixture would incorporate additional air as it flowed out of the outlet tube and before it could be ignited by the spark. The resulting fuel/air mixture would be leaner and more difficult to ignite, especially in cold weather.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A liquid fuel lantern comprising:

a fuel tank for storing liquid fuel, a burner assembly mounted above the fuel tank, the burner assembly including at least one outlet tube having an end adapted to support a mantle, a fuel tube extending from the fuel tank into the burner assembly for conveying fuel into the burner assembly, a pilot tube extending from the burner assembly and having an end which is positioned adjacent said end of the outlet tube, and ignition means adjacent said end of the pilot tube for igniting fuel which flows from said end of the pilot tube.

2. The lantern of claim 1 in which said ignition means includes a battery powered spark generator.

3. The lantern of claim 1 in which said ignition means includes a piezoelectric spark generator.

4. The lantern of claim 1 in which said ignition means includes an electrode adjacent said one end of the pilot tube and means for causing a spark to jump from the electrode to the pilot tube.

5. The lantern of claim 1 in which the burner assembly includes an inlet tube and a burner top having a chamber therein, the fuel tube extending into the inlet tube, the inlet tube and the outlet tube and the pilot tube being connected to the burner top and communicating with said chamber.

6. The lantern of claim 5 in which the pilot tube has a generally circular cross section and is flattened at said one end to provide a relatively narrow slit through which fuel flows.

* * * * *